United States Patent [19]

Ritschel et al.

[11] Patent Number: 4,536,339

[45] Date of Patent: Aug. 20, 1985

[54] BISAMIDES, A PROCESS FOR THEIR PREPARATION AND THEIR USE

[75] Inventors: Werner Ritschel, Hofheim am Taunus; Helmut Diery, Kelkheim; Martin Hille, Liederbach, all of Fed. Rep. of Germany

[73] Assignee: Hoechst Aktiengesellschaft, Fed. Rep. of Germany

[21] Appl. No.: 414,509

[22] Filed: Sep. 2, 1982

[30] Foreign Application Priority Data

Sep. 10, 1981 [DE] Fed. Rep. of Germany ..... 3135832

[51] Int. Cl.[3] ..... C11C 3/00

[52] U.S. Cl. ..... 260/404.5

[58] Field of Search ..... 260/404.5 R, 404.5 EO

[56] References Cited

U.S. PATENT DOCUMENTS 3,308,076 3/1967 DeLia et al. ..... 260/404.5 EO 4,072,641 2/1978 Loeb ..... 260/404.5 EO

*Primary Examiner*—Y. Harris-Smith

*Attorney, Agent, or Firm*—Connolly and Hutz

[57] ABSTRACT

Bisamides of the formula

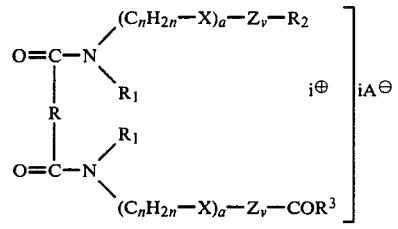

wherein R denotes the alkyl skeleton of a dimerized fatty acid having 22 to 42, preferably 34, C atoms, $R_1$ denotes hydrogen or a group of the formula $$-(C_nH_{2n}-X)_a-Z_v-R_2,$$

$R_2$ denotes hydrogen or a group $-COR_3$, $R_3$ denotes $C_1$-$C_{22}$-, preferably $C_8$-$C_{22}$-alkyl, X denotes an oxygen atom or a group of the formula $N-B_m$, B denotes hydrogen, methyl, ethyl, benzyl or a group of the formula $-Z_v-R_2$, n denotes a number from 2 to 6, preferably 2 or 3, a denotes a number from 0 to 5, v denotes a number from 0 to 100, preferably 0 to 20, Z denotes a group of the formula $-C_2H_4X(C_3H_6X)_b$ or $CH_2-CHY$ O or $C_nH_{2n}$, b denotes a number from 0 to 5, preferably 0, 1 or 2, i denotes a number from 0 to 2(a+b)+2 and A denotes an anion, m denotes a number from 1 to 2 and Y denotes hydrogen, methyl or ethyl, a process for their preparation and their use as demulsifiers for crude oil emulsions.

5 Claims, No Drawings

BISAMIDES, A PROCESS FOR THEIR PREPARATION AND THEIR USE

It is known that, during the lifting of crude oil emulsions, there is an increase in the water content of the crude oils lifted. This water, which is also lifted, forms a water-in-oil emulsion with the crude oil, it being possible for salts, such as sodium chloride, calcium chloride and magnesium chloride, to be dissolved in the water present in the emulsion. In addition, carbon dioxide and hydrogen sulfide are frequently present in the crude oil emulsions. All these substances produce corrosion damage in the lifting equipment and in the refinery, so that it is necessary, for this reason alone, to remove the salt-containing water from the crude oil emulsion with the aid of demulsifiers.

A demulsifier has the purpose of breaking the emulsion at a concentration used which is as low as possible and of bringing about, in this separation process, a complete separation-out of water and a reduction of the salt content to a minimum, as far as possible without expenditure or with the minimum amount of additional heat. The criteria for the quality of delivered crude oil are the residual content of salt and the water content.

Crude oils have different compositions depending on their origin, and the natural emulsion stabilizers present in the oil have a complicated and variable chemical composition, so that specific demulsifying agents must be developed for each oil. The requirements placed on a demulsifier become even greater due to the varying conditions of lifting and processing. Due to the continuous opening up of new oilfields and changes in the lifting conditions of old oilfields, the development of optimum demulsifiers for each particular purpose thus remains a pressing need.

Reaction products of alkylene oxide with alkylphenol/aldehyde resins are already known as nonionic demulsifiers for crude petroleum emulsions (U.S. Pat. Nos. 2,499,368, 2,499,270, 2,560,333 and 2,574,543). The use of block polymers and copolymers of propylene oxide and ethylene oxide for this purpose is also known (French Patent No. 1,069,615 and German Patent No. 1,018,179).

It has now been found that new bisamides not only exhibit an excellent activity as demulsifiers for crude oil, but also good effects as corrosion inhibitors.

The invention relates to new bisamides of the formula

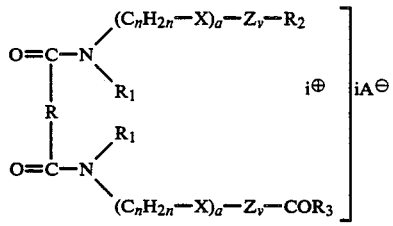

I wherein R denotes the alkyl skeleton of a dimerized fatty acid having 22 to 42, preferably 34, C atoms, $R_1$ denotes hydrogen or a group of the formula $-(C_nH_{2n}-X)_a-Z_v-R_2$, $R_2$ denotes hydrogen or a group $-COR_3$, $R_3$ denotes $C_1$–$C_{22}$-, preferably $C_8$–$C_{22}$-alkyl, X denotes an oxygen atom or a group of the formula $N—B_m$, B denotes hydrogen, methyl, ethyl, benzyl or a group of the formula $—Z_v—R_2$, n denotes a number from 2 to 6, preferably 2 or 3, a denotes a number from 0 to 5, v denotes a number from 0 to 100, preferably 0 to 20, Z denotes a group of the formula $—C_2H_4X(C_3H_6X)_b$ or $CH_2—CHY—O$ or $C_nH_{2n}$, m denotes 1 or 2, Y denotes hydrogen, methyl or ethyl, b denotes a number from 0 to 5, preferably 0, 1 or 2, i denotes a number from 0 to 2(a+b)+2 and A denotes an anion, such as, for example, the chloride, bromide, methyl sulfate, ethyl sulfate or dialkyl phosphate ion.

The symbols X, B, $R_1$, $R_2$, Z, n, a, v and b listed above can each have meanings within one compound which are identical or different from one another.

The preparation of the compounds of the above formula is carried out by initially condensing a dimerized fatty acid of the formula II $$HOOC—R—COOH \quad (II)$$

with a compound of the formula III $$R_1—HN—(C_nH_{2n}—X)_a—H \quad (III)$$

to give a compound of the formula IV,

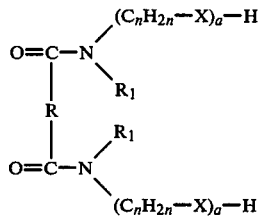

(IV)

reacting this compound of the formula IV, if appropriate, with ethylene oxide and/or propylene oxide or butylene oxide, esterifying the reaction product obtained with an acid of the formula V $$HOOC—R_3 \quad (V)$$

and then, where appropriate, neutralizing or quaternizing.

The preferred products suitable as dimerized fatty acids are those commercially available under the names ®Pripol 1010, ®Pripol 1022 and Fatty Acid 7002. See also R. W. Johnson in "Fatty acids".

These products can also contain proportions of trimeric or more highly condensed fatty acids. Thus, for example, Pripol 1022 contains about 20% of trimeric constituents and Pripol 1010 only contains about 3% of these. The dimerized fatty acids are initially condensed with two moles of a compound of the formula III. Examples of compounds of this type are aminoethylethanolamine, diethanolamine, propylenediamine, alkylpropylenediamine, ethylenediamine, diethylenetriamine, triethylenetetramine, tetramethylenepentamine, pentaethylenehexamine, mixed ethylene/propylene polyamines, such as 3-(2-aminoethyl)aminopropylamine and N,N'-bis(3-aminopropyl)ethylenediamine.

The condensation can be carried out without solvent in a melt of the reactants or in the presence of an inert solvent at the boiling point of the solvent. The preferred solvents for this purpose are toluene or xylene, which simultaneously serve to remove the water formed in the reaction.

The bisamide of the formula IV produced in this condensation can then be oxalkylated by known methods, preferably in the presence of a basic catalyst, such as sodium methylate or sodium hydroxide. Suitable alkylene oxides are, preferably, ethylene oxide, and also mixtures of ethylene oxide with propylene oxide or butylene oxide.

These oxalkylation products or the bisamides of the formula IV are then esterified with one or more carboxylic acids of the formula V. $C_8$–$C_{22}$-fatty acids are preferably employed as the carboxylic acids. The ratio of the amounts of carboxylic acids and bisamides of the formula IV, or their oxalkylation products, can be selected such that one or more acyl groups are present in the ester.

The esterification can be carried out with pure carboxylic acids of the formula V or with mixtures of various carboxylic acids of this type. In analogy to the first step, the reaction in this case can also be carried out in the melts of the reactants at temperatures of about 160°–180° C., or in an inert solvent as described above.

The esters thus obtained can then also be neutralized or quaternized, either by simple addition of acids, in the case when B is H or by reaction with alkylating reagents, such as, for example, methyl chloride, benzyl chloride, dimethyl sulfate or trimethyl phosphate, preferably at temperatures of 60°–70° C. in a lower alcohol or in toluene.

The products thus obtained are very suitable, both in their quaternized and also in their partially quaternized or non-quaternized or neutralized form, for the demulsification of crude oil emulsions. These products are added to the crude oil emulsion in concentrations of 2 to 400, preferably 5 to 50, ppm, either in an undiluted form or as solutions which have been diluted with an organic solvent in a ratio of up to 1:200.

The following examples are intended to illustrate the invention.

General procedure for the preparaton of the bisamides of the formula IV:

0.5 mole of a dimeric fatty acid is heated with one mole of an amine in the absence of a solvent in a distillation apparatus until 18 ml of $H_2O$ have been distilled off. The products obtained are viscous but pourable on warming.

Preparation of IVa:

By the general procedure from 285 g (0.5 mole) of Pripol 1022 and 104 g (1 mole) of aminoethylethanolamine.

Preparation of IVb:

From 285 g (0.5 mole) of Pripol 1022 and 103 g (1 mole) of diethylenetriamine.

Preparation of IVc:

From 420 g (0.5 mole) of Fatty Acid 7002 and 60 g (1 mole) of ethylenediamine.

Preparation of IVd:

From 285 g (0.5 mole) of Pripol 1010 and 180 g (1 mole) of tetraethylenepentamine.

EXAMPLE 1

660 g (15 moles) of ethylene oxide were added, by a known method, onto the bisamide IVa prepared by the general procedure. Then 250 g (1 mole) of stearic acid were added and the mixture was heated in a distillation apparatus until 18 g of $H_2O$ had distilled out. 1,300 g of isobutanol were added and the mixture was reacted in an autoclave with methyl chloride until no further uptake occurred. A 50% strength solution in isobutanol of the compound of the formula

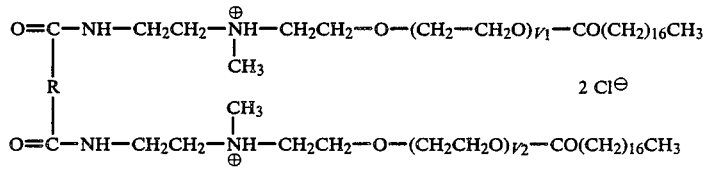

with $V_1+V_2=30$, was obtained; in this example and in the following, R denotes the alkyl skeleton of a dimerized fatty acid having 34 C atoms.

EXAMPLE 2

The bisamide IVb was heated with 120 g (0.5 mole) of tallow fatty acid in a distillation apparatus until 8 ml of $H_2O$ had distilled off. Then 280 g (5 moles) of propylene oxide were added in an autoclave by a known method, and subsequently 250 g (1 mole) of stearic acid were added and 18 g of $H_2O$ were distilled off. After adding 990 g of isobutanol, a brown pourable liquid having a substance content of 50%, including as the main component the compound of the formula

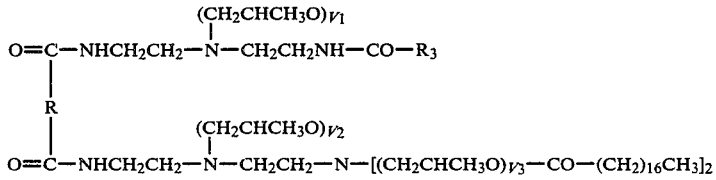

$R_3$=Talgfettalkyl, $V_1+V_2+2V_3=10$ with $R_3$=tallow fatty alkyl, $V_1+V_2+2V_3=10$, was obtained.

EXAMPLE 3

220 g (0.5 mole) of ethylene oxide and 280 g (5 moles) of propylene oxide were added by a conventional method onto the bisamide IVc. Then esterification was carried out with 250 g (1 mole) of tallow fatty acid as in Example 1. Subsequently, 1,400 g of isobutanol were added, 250 g (2 moles) of dimethyl sulfate and 80 g of 50% strength NaOH were added dropwise at 65° C., and the mixture was stirred for a further 2 hours at this temperature. A 50% strength solution of the active substance of the formula

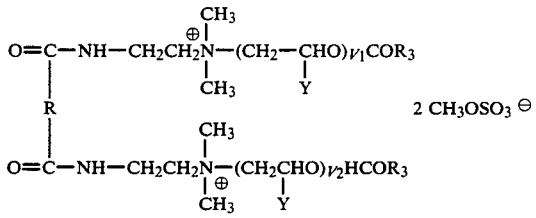

with $X=H+CH_3$, $V_1+V_2=20$, $R_3$=tallow fatty alkyl, was obtained.

EXAMPLE 4

The bisamide IVd was heated with 500 g (2 moles) of tallow fatty acid in a distillation apparatus until 35 ml of $H_2O$ had distilled off. Then 1,030 g of isobutanol were added and 120 g (2 moles) of glacial acetic acid were added dropwise at 60° C. The acetate was obtained as a 50% strength solution in isobutanol.

EXAMPLE 5

285 g (0.5 mole) of Pripol 1022 were heated with 105 g (1 mole) of diethanolamine in a distillation apparatus until 18 ml of $H_2O$ had distilled off. Then 240 g (1 mole) of tallow fatty acid were added and a further 18 ml of $H_2O$ were distilled off. After the addition of 590 g of isobutanol, a 50% strength solution of the active substance of the formula

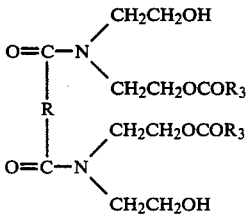

with $R_3$=tallow fatty alkyl, was obtained.

In the following text, the demulsifying activity of the compounds according to the invention on crude oil emulsions is shown, under the conditions and with the amounts used which are customary in the oilfields. For this purpose, the demulsifiers were used in 50% strength isobutanolic solutions which were injected with micrometering devices. The separation-out of the emulsified water was carried out in conical tubes which were calibrated and could be stoppered, and the amount of the emulsion used was 100 $cm^3$ in each case. The amounts of emulsion water which separated out in set times are reported in the trial tables in %. The absolute water content of the emulsions was determined in preliminary experiments by the Dean-Stark method in each case. The amount of demusifiers metered in, the absolute water content of the emulsion, the separating temperature and the origin of the emulsion are listed in the individual tables.

TABLE 1

| | |
|---|---|
| Demulsification temperature: | 40° C. |
| Water content of the emulsion: | 16% |
| Amount added: | 60 ppm |
| Origin: | Oasis/Libya |

| | % water separation Minutes | | | | | |
|---|---|---|---|---|---|---|
| Example | 30 | 60 | 90 | 120 | 150 | 180 |
| 1 | 35 | 47 | 59 | 75 | 90 | 94 |
| 2 | 73 | 86 | 94 | 98 | 100 | 100 |
| 3 | 30 | 43 | 55 | 68 | 81 | 91 |
| 4 | 40 | 73 | 94 | 100 | 100 | 100 |
| 5 | 51 | 68 | 82 | 91 | 96 | 99 |
| Without demulsifier | 0 | 0 | 0 | 0 | 0 | 0 |

TABLE 2

| | |
|---|---|
| Demulsification temperature: | 80° C. |
| Water content of the emulsion: | 38% |
| Amount added: | 40 ppm |
| Origin: | Lagoon/Venezuela |

| | % water separation Hours | | | | |
|---|---|---|---|---|---|
| Example | 1 | 3 | 6 | 12 | 18 |
| 1 | 55 | 62 | 70 | 91 | 100 |
| 2 | 78 | 91 | 96 | 100 | 100 |
| 3 | 28 | 68 | 84 | 92 | 96 |
| 4 | 32 | 75 | 96 | 100 | 100 |
| 5 | 45 | 66 | 83 | 92 | 97 |
| Without demulsifier | 0 | 0 | 0 | 1,5 | 2,2 |

TABLE 3

| | |
|---|---|
| Demulsification temperature: | 55° C. |
| Water content of the emulsion: | 65% |
| Amount added: | 45 ppm |
| Origin: | Emsland/FRG |

| | % water separation Minutes | | | | | |
|---|---|---|---|---|---|---|
| Example | 10 | 20 | 30 | 60 | 90 | 120 |
| 1 | 18 | 45 | 66 | 82 | 93 | 100 |
| 2 | 72 | 78 | 85 | 88 | 95 | 100 |
| 3 | 56 | 73 | 87 | 96 | 100 | 100 |
| 4 | 45 | 48 | 53 | 78 | 92 | 99 |
| 5 | 81 | 86 | 90 | 94 | 98 | 99 |
| Without demulsifier | 0 | 0 | 0 | 1,5 | 2,3 | 2,5 |

Inhibition of corrosion

The activity as corrosion inhibitors of the compounds according to the invention was determined by the loss in weight of test strips, having surface areas of 20 $cm^2$, in 20% strength sodium chloride solution at 60° C. for 6 hours. A continuous stream of carbon dioxide was bubbled through the stirred saline solution. Table 4 shows the inhibitory activity in %.

TABLE 4

| | Amount employed mg/l | |
|---|---|---|
| Example No. | 10 | 30 |
| 1 | 76 | 86 |
| 2 | 83 | 91 |
| 3 | 76 | 88 |
| 4 | 86 | 94 |
| 5 | 25 | 62 |

The numbers in the table indicate the corrosion protection in %.

We claim:

1. A bisamide of the formula

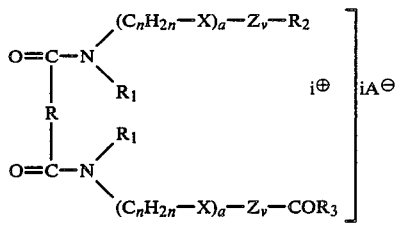

wherein R denotes the alkyl skeleton of a dimerized fatty acid having 22 to 42, preferably 34, C atoms, $R_1$ denotes hydrogen or a group of the formula $$—(C_nH_{2n}—X)_a—Z_v—R_2,$$

$R_2$ denotes hydrogen or a group $—COR_3$, $R_3$ denotes $C_1$-$C_{22}$-, preferably $C_8$-$C_{22}$-alkyl, X denotes an oxygen atom or a group of the formula $N—B_m$, B denotes hydrogen, methyl, ethyl, benzyl or a group of the formula $—Z_v—R_2$, n denotes a number from 2 to 6, a denotes a number from 0 to 5, v denotes a number from 0 to 100, but a and v are not both simultaneously zero, Z denotes a group of the formula $—C_2H_4X(C_3H_6X)_b$ or $CH_2—CHY\ OC_nH_{2n}$ or $C_nH_{2n}$, b denotes a number from 0 to 5, preferably 0, 1 or 2, i denotes a number from to to 2(a+b)+2 and A denotes an anion, m denotes 1 or 2, and Y denotes hydrogen, methyl or ethyl.

2. A process for the preparation of a bisamide of formula I as claimed in claim 1, which comprises initially condensing a dimerized fatty acid of the formula II $$HOOC—R—COOH \quad (II)$$

with a compound of the formula III $$R_1—NH—(C_nH_{2n}—X)_a—H \quad (III)$$

to give a compound of the formula IV

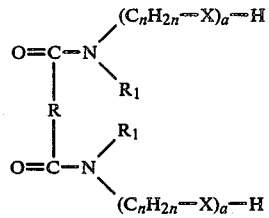

(IV)

reacting this compound of the formula IV, when v in said formula I is not zero or $R_1$ is not hydrogen, with ethylene oxide or propylene oxide or butylene oxide or a combination thereof; and esterifying the reaction product obtained with an acid of the formula V $$HOOC—R_3 \quad (V)$$

3. A process as claimed in claim 2, wherein subsequent to said esterifying with the acid of formula V, the esterification product is neutralized.

4. A process as claimed in claim 2, wherein X in said formula I is a said group of the formula $N—B_m$, and wherein subsequent to said esterifying with the acid of formula V, the nitrogen atom of said N—Bm in the esterification product is quaternized.

5. A bisamide as claimed in claim 1, wherein n denotes 2 or 3 and v of said formula I denotes 0 to 20.

* * * * *